US005609693A

United States Patent [19]

Dobrez et al.

[11] Patent Number: 5,609,693

[45] Date of Patent: Mar. 11, 1997

[54] METHODS FOR REMOVING ACRYLIC-BASED POLYMER COATINGS

[75] Inventors: John F. Dobrez, Flossmoor; David A. Strawser, Palatine, both of Ill.

[73] Assignee: Dober Chemical Corp., Midlothian, Ill.

[21] Appl. No.: 154,871

[22] Filed: Nov. 17, 1993

[51] Int. Cl.[6] ..... B08B 3/08; C23G 1/02

[52] U.S. Cl. ..... 134/38; 134/3; 134/18; 134/41; 134/22.19

[58] Field of Search ..... 134/22.19, 22.1, 134/38, 10, 18, 31, 41; 252/174.21, 174.22, 174.23, 174.24

[56] References Cited

U.S. PATENT DOCUMENTS

| | | | |
|---|---|---|---|
| 4,591,391 | 5/1986 | Shimizu et al. | 134/22.17 |
| 4,731,126 | 3/1988 | Dixit et al. | 134/38 |
| 4,832,868 | 5/1989 | Schmid et al. | 252/356 |
| 4,921,629 | 5/1990 | Malihi et al. | 252/170 |

FOREIGN PATENT DOCUMENTS

| | | |
|---|---|---|
| 0209071 | 1/1987 | European Pat. Off. . |
| 0209071A1 | 1/1987 | European Pat. Off. . |
| 0539065 | 1/1977 | U.S.S.R. . |

OTHER PUBLICATIONS

Eudragit E. standards Sheet, Rohm Pharma, Dec. 15, 1989.
Eudragit L, Data Sheet, Dec. 15, 1989.

*Primary Examiner*—Zeinab El-Arini
*Attorney, Agent, or Firm*—Frank J. Uxa

[57] ABSTRACT

Methods useful for removing an acrylic-based polymeric material located on a surface, for example, a surface of a piece of process equipment. The method includes contacting an acrylic-based polymeric material located on the surface of a piece of equipment with a composition containing at least about 20% by weight of water and an organic component containing at least one alkylene oxide group, preferably a plurality of alkylene oxide groups, per molecule in an amount effective to solubilize at least a portion of the acrylic-based polymeric material.

14 Claims, No Drawings

METHODS FOR REMOVING ACRYLIC-BASED POLYMER COATINGS

BACKGROUND OF THE INVENTION

The present invention relates to compositions and methods useful for removing acrylic-based polymer materials, such as acrylic-based polymers useful as enteric coatings, from vessels and other equipment employed in using such materials.

Acrylic-based polymer or polymeric materials have found substantial acceptance as enteric coatings, for example, to protect the stomach from various medications and/or vis versa. For example, such coatings can be used on aspirin-containing medications to insure that the stomach is not exposed to the aspirin. The coating is insoluble in stomach acid and dissolves only after the medication passes to that portion of the gastrointestinal tract beyond the stomach in which the pH is neutral or alkaline. These enteric coatings, which are known to be soluble based upon the pH of the medium in which they are placed, are produced using conventional coating equipment.

Over a period of time, the coating equipment and associated equipment, such as vessels, piping and the like, become heavily coated with such acrylic-based polymer material. Periodically, this process equipment must be cleaned in order to perform effectively. In particular, the coating material must be removed from the surfaces of the equipment in order that the equipment can perform its function effectively and efficiently. In addition, because the equipment is often used in the pharmaceutical and/or food industries, the cleaning operation itself must be effective to remove all of the coating material, and must be approved, for example, by the U.S. Food and Drug Administration, for use in the pharmaceutical and/or food industries. Such cleaning operations should also be cost effective.

Prior cleaning operations have involved manually scraping the acrylic-based polymer material from the process equipment. Also, very high concentrations of organic solvents have been employed to remove such material. These prior cleaning approaches are labor intensive and/or are expensive from the standpoint of cleaning composition cost and/or employ materials which are not approved for use in the pharmaceutical and/or food industries.

It would be advantageous to provide compositions and methods for removing such acrylic-based polymer materials from process equipment which are effective and efficient in removing the materials, and/or are cost effective, and/or use cleaning materials which are approved for use in the pharmaceutical and food industries.

SUMMARY OF THE INVENTION

New compositions and methods useful for removing an acrylic-based polymeric material located on a surface, for example, the surface of process equipment, have been discovered. The present compositions and methods provide a very useful and effective system for removing such acrylic-based polymeric materials. For example, it has been found that the use of selected materials, as described herein, in relatively low, cost acceptable concentrations in an aqueous medium, very effectively and efficiently remove acrylic-based polymeric materials from the surfaces of equipment. Thus, the present invention provides a very acceptable and cost effective approach to removing such material. The present compositions and methods are straight forward in chemical makeup and practice. In addition, because the present compositions preferably are made up of components which are approved for use in the pharmaceutical and/or food industries, the present invention finds substantial acceptability in cleaning process equipment used in these industries.

In one broad aspect, the present invention provides methods for removing an acrylic-based polymeric material located on a surface, for example, an interior surface of a piece of processing equipment. These methods comprise contacting the acrylic-based polymeric material located on the surface with a composition comprising at least about 20% by weight of water, preferably at least a major amount (i.e., at least about 50%) by weight of water, and an organic component containing at least one alkylene oxide group, preferably a plurality of alkylene oxide groups, per molecule. The organic component is present in an amount effective to solubilize at least a portion of the acrylic-based polymeric material on the surface. The present methods are surprisingly effective even when the pH of the composition is acidic, for example, having a pH of about 2 to about 3, which is approximately the pH present in the human stomach. Many of the acrylic-based polymeric materials which are removable in accordance with the present invention are known to be insoluble at highly acidic conditions, such as found in the human stomach. Thus, it has been found that the use of compositions comprising water and selected organic components, as described herein, even under acidic conditions provides effective solubilization and/or removal of such acrylic-based polymeric materials.

The compositions useful in the present methods are new and provide substantial and unexpected benefits, as described herein, and are, therefore, within the scope of the present invention.

In one embodiment, the compositions further comprise a carboxylic acid component selected from carboxylic acids, acid salts of carboxylic acids and mixtures thereof in an amount effective to reduce the adhesion between the acrylic-based polymeric material and the surface on which the material is present or located. Such carboxylic acid components, by themselves, in water are relatively ineffective to remove the polymeric material. However, in combination with the above-noted organic components, such carboxylic acid components provide a potentiating effect to render the acrylic-based polymeric material more readily removable from the surface, for example, relative to using an identical composition without the carboxylic acid component.

In one embodiment, the present compositions further comprise a solvent component, other than the organic component, in an amount effective, in combination with the organic component, to facilitate solubilizing the acrylic-based polymeric material, for example, relative to using an identical composition without the solvent component. This solvent component preferably includes at least one alkylene oxide group.

A particularly useful class of compositions comprise water; an organic component, as described herein; a polycarboxylic acid material, as described herein; and a solvent component, as described herein.

Each of the components included in the present compositions is preferably approved, for example, by the U.S. Food and Drug Administration, for use in the pharmaceutical and/or food industries in process equipment treating, e.g., cleaning, operations.

In a further broad aspect of the present invention, methods of removing a polymeric material, such as an acrylic-based polymeric material, located on the interior surface of a piece of equipment are provided. Such methods comprise: (1) passing a composition, such as the compositions described elsewhere herein, into the piece of equipment to contact at least a portion of the polymeric material located on the interior surface of the piece of equipment; (2) routing the polymeric material-containing composition produced in step (1) for a first period of time so that the composition included in the routed polymeric material-containing composition is passed into the piece of equipment only one time; and, thereafter, (3) recirculating the polymeric material-containing composition obtained in a second period of time into the piece of equipment to contact at least a portion of the polymeric material located on the interior surface of the piece of equipment. This aspect of the invention takes advantage of the finding that during the first part of the composition/polymeric material contacting relatively large particles of the polymeric material are removed from the interior surface of the equipment. These relatively large particles are best removed from the system to avoid complications in recirculating the particles. After this initial period of time, most, if not substantially all, of the removal occurs because of solubilization of the polymeric material. During this phase of the process, the composition is recirculated or recycled back to the piece of equipment so as to take advantage of the remaining solubility of the polymeric material in the composition.

The compositions useful in the above-noted three (3) step method are preferably made from a diluent, such as water, for example, city or tap water which has been treated to reduce hardness, and an active material concentrate, such as a concentrate containing water and a relatively large concentration of an organic component, as described herein. The active material concentrate may, and preferably does, include a relatively large concentration of a carboxylic acid component and/or a solvent component, as described herein. In a particularly useful embodiment, additional active material concentrate is added to the polymeric material-containing composition being recirculated in step (3). This additional active material concentrate is preferably added in an amount effective to substantially maintain or increase the effectiveness of the polymeric material-containing composition being recirculated in step (3) to remove polymeric material from the interior surface of the piece of equipment. Preferably, the composition has an ionic character and the electric conductivity of the polymeric material-containing composition is monitored. The additional active material concentrate is preferably added to the polymeric material-containing composition being recirculated in step (3) in response to the value of the monitored electrical conductivity. The monitoring and adding of additional concentrate are preferably controlled by an electronic controller programmed to maintain the electrical conductivity of the polymeric material-containing composition within a predetermined range.

These and other aspects and advantages of the present invention will become apparent in the following detailed description and claims in which like parts bear like reference numerals.

DETAILED DESCRIPTION OF THE INVENTION

Various acrylic-based polymer or polymeric materials are useful as delayed release, preferably enteric delayed release, coatings for medications and the like materials for human and animal consumption. In making such coated products, the process equipment used often becomes heavily coated with such polymeric materials. As part of the routine cleaning operation, the piece of equipment in question is taken out of service and processed to remove the acrylic-based polymeric material located on the surfaces, for example, the inside or interior surfaces, of the equipment.

The present invention provides compositions and methods useful to remove such acrylic-based polymeric materials from the surfaces of process equipment.

The acrylic-based polymer or polymeric materials which are removable in accordance with the present invention may be chosen from a wide variety of such materials. Particularly applicable acrylic-based polymeric materials are those which are useful in delayed release coatings, such as enteric delayed release coatings, for medications. Such materials are preferably anionic in character. One very useful class of acrylic-based materials are polymers derived from one or more monomers selected from methacrylic acid, methacrylic acid esters and mixtures thereof. Among the methacrylic acid esters which can be employed as monomers, methacrylic acid methyl ester provides acrylic-based polymeric materials which are very effectively removed in accordance with the present invention. The acrylic-based polymeric materials may be insoluble in buffered aqueous solutions at a pH of about 5 or lower. The acrylic-based polymeric material may include a plasticizer component in an amount effective to increase the elasticity of the medication coatings made from such materials. Examples of useful plasticizer components include polyethylene glycols, dibutyl phthalate, glycerol triacetate, caster oil, 1,2-propylene glycol, citric acid esters, such as triethyl citrate and mixtures thereof.

In one general embodiment of the present invention, methods for removing such acrylic-based polymeric materials located on a surface comprise contacting this material with a composition containing at least about 20% by weight, preferably at least about 50% by weight, of water, for example, city or tap water, and an organic component containing at least one alkylene oxide group, preferably a plurality of alkylene oxide groups, per molecule in an amount effective to solubilize at least a portion of the acrylic-based polymeric material located on the surface.

In addition, the present compositions preferably include an effective amount of a carboxylic acid component and/or a solvent component other than the organic component. More preferably, both a carboxylic acid component and a solvent component are included. The carboxylic acid component is present in an amount effective to reduce the adhesion between the acrylic-based polymeric material and the surface on which the material is located. The solvent component is present in an amount effective, in combination with the organic component, to facilitate solubilizing the acrylic-based polymeric material. Each of the components of the present compositions is preferably soluble in the composition.

The organic component may be any suitable component which is generally organic in character and includes at least one alkylene oxide group, and preferably a plurality of alkylene oxide groups, per molecule. As with all of the other components included in the present compositions, it is preferred that the organic component be approved, for example, by the U.S. Food and Drug Administration, for use in the pharmaceutical and/or food industries in treating, e.g., cleaning, process equipment. Such approval or approvals are advantageous since the present methods are particularly applicable in the pharmaceutical and/or food industries for cleaning process equipment. Components which are substantially completely removed from the process equipment being treated, for example, such as by rinsing the equipment with water, are particularly useful in the present invention.

As noted above, the organic component includes at least one alkylene oxide group. Without wishing to limit the invention to any particular theory of operation, it is believed that the alkylene oxide group or groups included in the organic component, as well as in the solvent component and/or other components present in the present compositions, provide for solubilization of the acrylic-based polymeric material. The specific mechanism by which the acrylic-based polymeric material is solubilized is not fully understood. However, such solubilization is not based entirely, or even primarily, on the pH of the composition. For example, the present invention is effective to remove acrylic-based polymeric materials which are insoluble at pHs in buffered aqueous solutions at pHs of about 5 or less even though the present compositions preferably have pHs of less than about 5, more preferably in the range of about 2 to about 3.

As used herein, the term "alkviene oxide group" means a group having the following structure:

—O—R wherein R is selected from monovalent hydrocarbyl radicals, divalent hydrocarbyl radicals and substituted counterparts thereof. Examples of monovalent and divalent radicals from which R can be chosen include alkyl, alkylene, alkenyl, alkenylene, aryl, arylene, aralkyl, aralkylene, alkaryl, alkarylene, aralkenyl, aralkenylene, alkenaryl, alkenarylene and substituted counterparts thereof. Each R is preferably aliphatic. Each R preferably has 1 to about 5, more preferably 2 to about 4, carbon atoms. Particularly useful examples of R include ethyl, ethylene, propyl, propylene, butyl and butylene radicals.

As used herein, the term "substituted counterpart" means any of the presently useful hydrocarbyl radicals in which at least one of the H groups is replaced by a substituent group containing an element other than carbon and hydrogen, such as halogen, sulfur, phosphorus, nitrogen and the like. Such substituent groups should be such as to not substantially interfere with the functioning, effectiveness and characteristics of the alkylene oxide-containing component in the present invention.

Although the organic component may have only one alkylene oxide group per molecule, it is much preferred that the organic component include a plurality, for example, at least three, alkylene oxide groups per molecule. In a more preferred embodiment, the number of alkylene oxide groups per molecule of the organic component is in the range of about 4 to about 20, and still more preferably in the range of about 5 to about 15. Again without wishing to limit the invention to any particular theory of operation, it has been found that a general correlation exists between the effectiveness of the organic component to solubilize the acrylic-based polymeric material and the number of alkylene oxide groups per molecule in the organic component. Thus, it has been found that the rate and/or degree of solubilization and removal of the acrylic-based polymeric material is increased as the number of alkylene oxide groups per molecule of the organic component is increased.

Various commercially available materials may be employed as organic components in the present invention. For example, a product including a mixture containing ethoxylated and/or propoxylated $C_8$–$C_{10}$ alcohols sold by Rhone-Poulenc under the trademark Antarox BL-240 is one useful material. This material may be identified as follows: $C_nH_{n+1}(OCH_2CH_2)_x(OCH_2CH_2CH_2)_y OH$, wherein n is an integer in the range of about 8 to 10, and x+y is in the range of about 6 to about 12. Additional materials which are useful as organic components in the present invention are those materials prepared by the reaction of octylphenol or nonylphenol with ethylene oxide. Such materials include those products sold by Rohm and Haas Company under the trademarks Triton X-15, Triton X-35, Triton X-45, Triton X-114, Triton X-100, Triton X-102, Triton X-165. Such materials include between 1 and about 16 ($OCH_2CH_2$) groups per molecule.

The specific amount of the organic component included in the present compositions is not critical to the present invention and may vary depending, for example, on the specific organic component being employed and the specific acrylic-based polymeric material to be removed. However, the organic component should be chosen so that the amount used is cost effective. Thus, either the amount of organic component should be relatively minor (compared to the water component) and/or the cost per unit of the organic component should be relatively low. Based on present costs and performance characteristics of commercially available organic components, it is preferred that the organic component be included in the compositions used to remove the acrylic-based polymeric material from the equipment surfaces in the range of about 0.1% to about 10% by weight, more preferably in the range of about 0.1% to about 5% by weight of the composition.

Any of various carboxylic acid components can be employed in accordance with the present invention. Such components include the carboxylic acids themselves, acid salts of such carboxylic acids and mixtures thereof. Such carboxylic acids include at least one carboxylic acid functionality, preferably two or more carboxylic acid functionalities (that is, the carboxylic acid components are preferably polycarboxylic acid components), and have 1 to about 30 carbon atoms, preferably about 3 to about 20 carbon atoms, per molecule. It is important that if a salt of a carboxylic acid is employed, that the salt not be fully neutralized. Thus, acid salts, that is salts which include at least one carboxylic acid functionality, may be employed. Neutral salts of carboxylic acids are generally ineffective, even in combination with the organic component of the present compositions, to facilitate removal of acrylic-based polymeric material in accordance with the present invention.

Examples of carboxylic acid components useful in the present invention include formic acid, acetic acid, propionic acid, butyric acid, pentanoic acid, citric acid, tartaric acid, saccharic acid, maleic acid, oxalic acid, malonic acid, succinic acid, glutaric acid, adipic acid, pimelic acid, suberic acid, azelaic acid, sebacic acid, diglycolic acid, phthalic acid, acid salts thereof, mixtures thereof and the like. Compositions including citric acid provide excellent results.

The specific amount of carboxylic acid component employed in accordance with the present invention is not critical, and may vary depending, for example, upon the specific acid and/or acid salt employed and the specific removal application involved. However, in view of cost and performance considerations, it is preferred that the carboxylic acid component be present in the range of about 0.1% to about 10%, more preferably in the range of about 0.18 to about 5%, by weight of the composition.

The present compositions may include, in addition to the organic component described herein, a solvent component in an amount effective, in combination with the organic component, to facilitate solubilizing the acrylic-based polymeric material. This solvent component is preferably organic in nature and is believed to act, at least in part, to maintain the acrylic-based polymeric material in solution, that is to avoid redeposition of the acrylic-based polymeric material on the surface from which it has been removed. In a particularly useful embodiment, the solvent material includes at least one alkylene oxide group and preferably at least assists the organic component, and may act separately from or independently of the organic component, in solubilizing the acrylic-based polymeric material. In general, the solvent components useful in the present invention are more linear in structure than are the organic component, and/or include fewer alkylene oxide groups per molecule than does the organic component. Thus, if the solvent component is used alone, in water, to remove the acrylic-based polymeric material from equipment surfaces, the solvent component is generally less effective in solubilizing the acrylic-based polymeric material than is the organic component at the same concentration.

One particularly useful solvent component is that identified as triethylene glycol monoethyl ether sold by Olin under the trademark Poly-solve TE. Other alkylene oxide-containing alcohols and glycols may also be employed, particularly those in which the alkylene oxide groups include 1 to about 4 carbon atoms, the alcohol or glycol includes about 2 to about 10 carbon atoms and there is 1 to about 5 alkylene oxide groups per molecule.

In order to be cost effective and provide the performance characteristics desirable in the present invention, it is preferred that the solvent component be present in the present composition in the range of about 0.1% to about 10%, more preferably about 0.1% to about 5%, by weight of the composition.

The present compositions may be derived from concentrates, for example, by combining water and a concentrate or concentrates. These concentrates, which include a liquid medium, preferably water, and relatively large concentrations of the active component or components, are within the scope of the present invention. Such concentrates preferably include at least about 20% by weight of water and about 1% to about 30% by weight of an organic component. If a carboxylic acid component and/or a solvent component is present, such components are preferably each about 1% to about 40% by weight of the concentrate. In certain instances, for example, when commercially available materials are used as components of the present compositions/concentrates, the active material is present in a mixture, such as a solution, with an inert component or diluent. The specific amounts of the various components of the present compositions noted above refer to the amount of the active material without considering any inert component or diluent.

The present compositions contact the acrylic-based polymeric material located on the surface of equipment at conditions effective to remove such polymeric material. Although ambient or room temperature compositions can be employed, it is preferred to use compositions at relatively elevated temperatures, preferably in the range of about 80° F. to about 180° F. during such contacting. In order to obtain such elevated temperatures it is desirable to pass the composition through a heat exchanger prior to introducing the composition into the equipment to be cleaned.

The contacting times vary greatly depending, for example, on the specific composition and contacting conditions being employed and on the specific removal application involved. Preferably, such contacting occurs for a time in the range of about 30 seconds or about one minute to about 1 hour or about 2 hours. In addition, the composition can be used on a once-thru basis, that is the composition is passed into the equipment to be cleaned only one time, or can be recirculated or recycled back through the equipment to be cleaned.

In a particularly useful embodiment, the composition is employed on a "once-thru" basis for a first period of time, preferably for about 30 seconds to about 10 or about 20 minutes, and, thereafter, is used by being recirculated through the equipment to be cleaned for a second period of time, preferably for about 1 minute to about 1 hour or about 2 hours or more. During the first period of time relatively large particles of the acrylic-based polymeric material are removed from the equipment surface or surfaces. In order to avoid handling problems, redeposition problems and other complications, these relatively large particles, together with the composition in which the particles are present, are removed from the process. After this first period of time, much, if not all, of the acrylic-based polymeric material removed is solubilized in the composition. In order to take more advantage of the solubility of the acrylic-based polymeric material in the composition, and preferably to maintain the composition at a relatively elevated temperature, during the second period of time the acrylic-based polymeric material-containing composition is recirculated or recycled back to (reintroduced into) the equipment being cleaned, preferably through a heat exchanger, until the desired level of acrylic-based polymeric material removal has been obtained.

After this degree of removal has been achieved, the cleaned piece of equipment is preferably rinsed with water, more preferably with deionized water, in preparation for placing the equipment back into service.

Electric conductivity measurements of the composition and the rinse medium are preferably employed, for example, to maintain the "strength" of the composition used for removing the acrylic-based polymeric material, particularly when the composition is being used in the "recycle" mode, and to validate the cleanliness of the equipment after the equipment has been cleaned.

In one embodiment, in which the present composition has an ionic character, the electric conductivity of the acrylic-based polymeric material-containing composition is monitored as it exits the equipment to be cleaned. One can determine, at least semi-quantitatively, the "strength" of this composition, that is the ability of the composition to remove further acrylic-based polymeric material based upon the electric or electrical conductivity of the composition. Generally, the ability of the composition to solubilize acrylic-based polymeric material is directly proportional to, that is increases with increases in and decreases in, the electrical conductivity of the composition. By monitoring the electrical conductivity, and thus the "strength", of this composition, one can determine whether or not active material concentrate needs to be added to the composition being used. Preferably, sufficient active material concentrate is added to the recirculating composition so as to maintain the "strength" of the composition at a certain level. This electrical conductivity monitoring and composition strength controlling function is preferably accomplished by an electronic controller, such as that included in the system sold by Dober Chemical Corporation under the trademark Chematic C.I.P.®.

The use of electrical conductivity to validate the cleanliness of a piece of equipment after treatment with the present compositions can be, and preferably is, accomplished by monitoring the electrical conductivity of ultra pure, deionized water used to rinse the clean piece of equipment. Thus, by monitoring the electrical conductivity of this rinse medium both upstream of the cleaned piece of equipment and downstream of the cleaned piece of equipment, the cleanliness of the piece of equipment can be validated when these two electrical conductivities are substantially the same.

After the piece of equipment has been validated as being clean, it can be returned to service, for example, in the pharmaceutical industry to coat medications with an enteric coating comprising an acrylic-based polymeric material.

The following non-limiting examples illustrate certain advantages of the present invention.

EXAMPLES 1 TO 17

A series of compositions were prepared, by blending various components together, and tested for effectiveness in removing an acrylic-based polymer film or coating from a steel coupon.

The components used in preparing these compositions were as follows:

(A) Water (B) A commercially available mixture containing ethoxylated and/or propoxylated $C_8$–$C_{10}$ alcohols sold by Rhone-Poulenc under the trademark Antarox BL-240. This material is believed to include at least about 3 or more ethoxy and/or propoxy groups per molecule.

(C) Citric Acid (D) Neutral trisodium citrate salt (E) A commercially available product containing triethylene glycol monoethyl ether sold by Olin under the trademark Poly-solve TE. This material is believed to include one ethoxy group per molecule.

(F) A commercially available product containing ethoxylated octyl phenol sold by Union Carbide under the trademark Triton X114.

(G) Propylene glycol

These compositions had the following make-ups.

| | Component, Wt. % | | | | | | |
|---|---|---|---|---|---|---|---|
| Composition | A | B | C | D | E | F | G |
| 1 | 73 | — | — | — | 27 | — | — |
| 2 | 97.3 | — | — | — | 2.7 | — | — |
| 3 | 97.3 | — | 2.7 | — | — | — | — |
| 4 | 97.3 | — | — | 2.7 | — | — | — |
| 5 | 94.6 | 2.7 | 2.7 | — | — | — | — |
| 6 | 96.8 | 0.5 | 2.7 | — | — | — | — |
| 7 | 94.6 | 5.4 | — | — | — | — | — |
| 8 | 94.6 | — | — | — | 5.4 | — | — |
| 9 | 90 | — | 5.0 | — | 5.0 | — | — |
| 10 | 95 | — | 2.5 | — | 2.5 | — | — |
| 11 | 94.5 | 0.5 | 2.5 | — | 2.5 | — | — |
| 12 | 89.8 | — | 10 | — | — | 0.2 | — |
| 13 | 67.5 | 5.5 | — | — | 27 | — | — |
| 14 | 96.75 | 0.55 | — | 2.7 | — | — | — |
| 15 | 98.375 | 0.275 | — | — | 1.35 | — | — |
| 16 | 10 | — | 10 | — | — | — | 80 |
| 17 | 95.5 | — | 0.5 | — | — | — | 4 |

Each of these compositions was tested as follows. A steel coupon was dipped into an aqueous suspension containing an anionic polymer synthesized from methacrylic acid and methacrylic acid methyl ester. This polymer is sold by Rohm Pharma under the trademark Eudragit L, and is used as an enteric film coating in the pharmaceutical industry. This dipping was followed by drying at 100° F. The dipping/drying steps were repeated two times (for a total of three dipping/drying cycles) and resulted in forming an acrylic-based polymeric coating on the coupon.

The coated coupon was immersed in the composition, which was heated to 90° C., for 10 minutes. Thereafter, the coupon was removed from the composition and inspected to determine how much, if any, of the coating had been removed from the coupon.

Results of these tests were as follows:

Composition 1—100% removal of the coating.

Composition 2—10% removal of the coating.

Composition 3—No removal of the coating. However, the coating was loosened from the coupon so that upon the application of a water spray, 85% of the coating was removed.

Composition 4—No removal or loosening of the coating.

Composition 5—95% removal of the coating.

Composition 6—90% removal of the coating.

Composition 7—95% removal of the coating.

Composition 8—5% removal of the coating.

Composition 9—100% removal of the coating.

Composition 10—Less than 1% removal of the coating.

Composition 11—100% removal of the coating.

Composition 12—98% removal of the coating.

Composition 13—100% removal of the coating.

Composition 14—100% removal of the coating.

Composition 15—95% removal of the coating.

Composition 16—100% removal of the coating.

Composition 17—No removal of the coating.

These examples illustrate certain of the important features of the present invention. For example, very high concentrations of Component E (Compositions 1 and 13) are effective to remove the acrylic-based polymeric coating. However, such high concentrations are not cost effective and, therefore, are not practically acceptable. The same is true regarding Composition 16, which included 80% propylene glycol. When the concentration of Component E by itself (other than water) is brought down to economically acceptable levels (Compositions 2 and 8), the compositions do not satisfactorily remove the coating. When propylene glycol is employed at a reduced concentration together with citric acid (Composition 17), the composition did not remove the coating. Also, citric acid alone in water (Composition 3) does not remove the coating, but acts to loosen the coating or reduce the adhesion between the coating and the coupon. When the citric acid is completely neutralized (Composition 4), the resulting neutral citrate salt in water is ineffective to remove the coating or even loosen the coating.

Compositions including only Component B (other than water) which includes a plurality of alkylene oxide groups per molecule (Composition 7) or including only Component B and citric acid (other than water) (Compositions 5 and 6) are highly effective to remove the coating, even at relatively low concentrations which would be cost effective. Compositions 9 and 10 indicate that the combination of Components C and E can be highly effective in removing the coating provided that a sufficient amount of the combination is employed. Composition 11, which includes all of Components B, C and E at relatively low concentrations, provides very effective removal of the coating. Composition 15, which includes the alkylene oxide group-containing Components B and E alone (other than water) is highly effective to remove the coating at relatively low concentrations which would be cost effective.

EXAMPLES 18 TO 23

An active material concentrate was produced using softened tap water and various components identified in the previous Examples. This concentrate had the following composition:

| | wt. % |
|---|---|
| Softened tap water | 40.5 |
| Component B | 5.5 |
| Component C | 27.0 |
| Component E | 27.0 |

This concentrate was added to additional quantities of tap water to produce compositions containing 1%, 2%, 5%, 10%, 15% and 20% by volume of the concentrate. The pH of each of these compositions was measured and found to be between 2 and 3.

Each of the above-noted compositions is highly effective in removing the acrylic-based polymeric material described in the previous Examples from equipment used in producing medication coatings from such polymeric materials.

While this invention has been described with respect to various specific examples and embodiments, it is to be understood that the invention is not limited thereto and that it can be variously practiced within the scope of the following claims.

What is claimed is:

1. A method for removing an acrylic-based polymeric material useful as enteric coatings located on a surface of a vessel or other process equipment comprising the steps of:

contacting said acrylic-based polymeric material located on said surface with a composition comprising at least about 50% by weight of water, an organic component containing at least one alkylene oxide group per molecule in an amount effective to solubilize at least a portion of said acrylic-based polymeric material, and a carboxylic acid component selected from the group consisting of carboxylic acids, acid salts of carboxylic acids and mixtures thereof in an amount effective to reduce the adhesion between said acrylic-based polymeric material and said surface; and removing said acrylic-based polymeric material from said surface.

2. The method of claim 1 wherein said organic component includes a plurality of alkylene oxide groups per molecule.

3. The method of claim 1 wherein said organic component is soluble in said composition and is present in said composition in an amount in a range of about 0.1% to about 10% by weight.

4. The method of claim 1 wherein said organic component comprises compounds selected from the group consisting of alkoxylated alcohols and mixtures thereof wherein said at least one alkylene oxide group contains 1 to about 5 carbon atoms.

5. The method of claim 1 wherein said composition further comprises a solvent component, in addition to said organic component, in an amount effective, in combination with said organic component, to facilitate solubilizing said acrylic-based polymeric material.

6. The method of claim 5 wherein said solvent component includes at least one alkylene oxide group per molecule.

7. The method of claim 1 wherein said composition includes only components approved for use in pharmaceutical and food industries in process equipment cleaning operations.

8. The method of claim 1 wherein said carboxylic acid component is present in said composition in an amount in the range of about 0.1% to about 10% by weight.

9. The method of claim 1 wherein said carboxylic acid component is such that a composition consisting of water and said carboxylic acid component is substantially ineffective to remove said acrylic-based polymeric material from said surface.

10. A method of removing an acrylic-based polymeric material located on an interior surface of a piece of equipment comprising the steps of:

(1) passing a composition comprising at least about 50% by weight of water, an organic component containing at least one alkylene oxide group per molecule in an amount effective to solubilize at least a portion of said acrylic-based polymeric material located on said interior surface, and a carboxylic acid component selected from the group consisting of carboxylic acids, acid salts of carboxylic acids and mixtures thereof in an amount effective to reduce adhesion between said acrylic-based polymeric material and said interior surface into said piece of equipment to contact at least a portion of said acrylic-based polymeric material located on said interior surface of said piece of equipment, said passing acting to form an acrylic-based polymeric material-contaminated composition;

(2) routing said acrylic-based polymeric material-contaminated composition for a first period of time so that said composition included in said acrylic-based polymeric material-contaminated composition is passed into said piece of equipment only one time; and, thereafter, (3) recirculating said acrylic-based polymeric material-contaminated composition obtained in a second period of time into said piece of equipment to contact at least a portion of said acrylic-based polymeric material located on the interior surface of said piece of equipment; and (4) removing said acrylic-based polymeric material from said interior surface.

11. The method of claim 10 wherein said composition is made from water and an active material concentrate including a quantity of said organic component, and an additional amount of said active material concentrate is added to said acrylic-based polymeric material-contaminated composition being recirculated in step 3, said additional active material concentrate being added in an amount effective to substantially maintain or increase the effectiveness of said acrylic-based polymeric material-contaminated composition being recirculated in step 3 to remove said acrylic-based polymeric material from the interior surface of the piece of equipment, said active material concentrate comprising at least about 20% by weight of water and about 1% to about 30% by weight of said organic component.

12. The method of claim 10 wherein said composition has an ionic character and wherein electrical conductivity of said acrylic-based polymeric material-contaminated composition is monitored to obtain electrical conductivity measurements.

13. The method of claim 12 wherein said additional active material concentrate is added to said acrylic-based polymeric material-contaminated composition being recirculated in step 3 in response to said electrical conductivity measurements.

14. The method of claim 13 wherein the electrical conductivity of said acrylic-acid polymeric material-contaminated composition is monitored and said additional active material concentrate is added utilizing an electronic controller programmed to maintain the conductivity of said acrylic-acid polymeric material-contaminated composition within a predetermined range.

* * * * *

UNITED STATES PATENT AND TRADEMARK OFFICE

CERTIFICATE OF CORRECTION

PATENT NO. : 5,609,693

DATED : March 11, 1997

INVENTOR(S) : Dobrez et al

It is certified that error appears in the above-indentified patent and that said Letters Patent is hereby corrected as shown below:

Column 1, line 64; delete "alkviene" and insert in place thereof --alkaline--.

Column 6, line 61; delete "0.18" and insert in place thereof --0.1%--.

Signed and Sealed this

Twenty-third Day of December, 1997

Bruce Lehman

*Attest:*

BRUCE LEHMAN

*Attesting Officer*

*Commissioner of Patents and Trademarks*